US007666106B1

(12) United States Patent
Hebert

(10) Patent No.: US 7,666,106 B1
(45) Date of Patent: Feb. 23, 2010

(54) POSTURE CORRECTING TOOL FOR GOLF SWING

(76) Inventor: Bobby Dale Hebert, 4240 Sunken Ct., Port Arthur, TX (US) 77642

( * ) Notice: Subject to any disclaimer, the term of this patent is extended or adjusted under 35 U.S.C. 154(b) by 4 days.

(21) Appl. No.: 12/338,900

(22) Filed: Dec. 18, 2008

(51) Int. Cl.
*A63B 69/36* (2006.01)

(52) U.S. Cl. ..... 473/215; 473/257; 473/274

(58) Field of Classification Search ..... 473/207, 473/208, 215, 257, 266, 269–270, 271, 272, 473/273, 274, 275, 276, 277
See application file for complete search history.

(56) References Cited

U.S. PATENT DOCUMENTS 3,623,733 A * 11/1971 Cavanaugh ..... 473/265
3,712,625 A * 1/1973 Taylor ..... 473/274
4,657,135 A * 4/1987 Kjose ..... 206/315.3
5,203,569 A * 4/1993 Rilling ..... 473/277
5,439,226 A * 8/1995 Luedtke ..... 473/232
5,577,729 A * 11/1996 Sabour ..... 473/274
5,634,858 A * 6/1997 Bellagamba ..... 473/257
5,707,300 A * 1/1998 May et al. ..... 473/257
5,762,565 A * 6/1998 Milam et al. ..... 473/271
5,954,619 A * 9/1999 Petrone ..... 482/104
6,093,111 A * 7/2000 Senn ..... 473/277
6,575,844 B1 * 6/2003 Gray ..... 473/277
6,843,730 B1 1/2005 Bellagamba
6,988,957 B2 * 1/2006 Bender ..... 473/266

* cited by examiner

*Primary Examiner*—Nini Legesse
(74) *Attorney, Agent, or Firm*—Buskop Law Group, PC; Wendy Buskop

(57) ABSTRACT

A posture correcting tool surrounding a player while performing a swing practice having an adjustable freestanding body unit adapted to provide position feedback to a player relative to the player's sway during a golf swing, with two substantially vertical telescoping legs and a substantially horizontal buttocks bar slidably and moveably connected between the first and second telescoping legs, an adjustable freestanding head unit independent of the body unit and disposed opposite the adjustable freestanding body unit, having a telescoping substantially horizontal head bar connected to an adjustable substantially vertical head bar support that further engages a third weighted foot plate connected to the adjustable substantially vertical head bar support.

12 Claims, 8 Drawing Sheets

POSTURE CORRECTING TOOL FOR GOLF SWING

FIELD

The present embodiments relate to a golf practice device that has a free standing body unit with two telescoping vertical legs that support a bar for touching the rear bottom of a player and a free standing head unit that will stimulate the golfer when the head of the golfer is in the wrong position to create a correct golf swing.

BACKGROUND

A need has existed for a golf swing tool that helps with head location and behind location of a golfer while simultaneously providing information to the golfer about incorrect left and right sway during a swing.

A need has existed for a golf swing tool that is useful with a child, an adult and a handicapped person that is easy to operate and set up.

A need has existed for a golf swing tool that improves the posture of the player which is lightweight and easy to move and can be collapsible to fit a briefcase.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a golf practice device that has a free standing body unit with two telescoping vertical legs that support a bar for touching the rear bottom of a player and a free standing head unit that will stimulate the golfer when the head of the golfer is in the wrong position to create a correct golf swing.

The embodiments of the tool can have two telescoping vertical legs, adjustable free standing units, a head unit and a body unit that is not stood upon by a golfer, rather, the golfer stands between legs of the body unit, and the head unit is opposite the body unit.

The embodiments can be contemplated to be telescoping and the entire unit can be contemplated to be collapsible so that the entire device, both units can be put into a small briefcase, or a small space for easy storing.

The tool can be contemplated to have no hinges to come apart and no small parts, so that it can be used around small children.

The tool can be useful with a child, an adult and a handicapped person that it is easy to operate and set up.

The telescoping members of the device can make both units have a very small overall size, such as and overall width and length of about 2 feet by about 2 feet.

Figure 1:
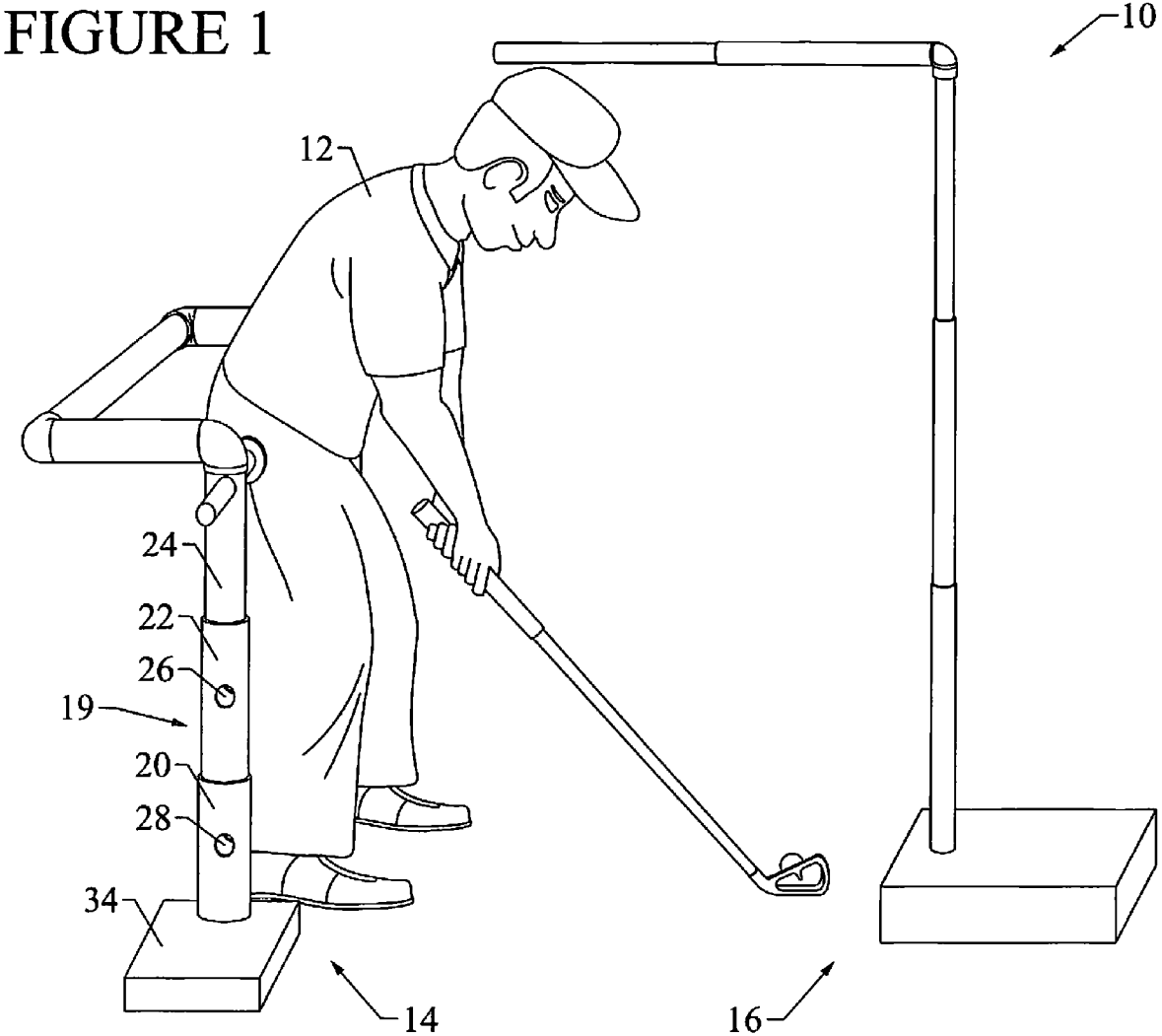
FIG. 1 shows an side view of the posture correcting tool.

FIG. 1 shows a front view of the posture correcting tool (10) surrounding a golf player (12) while performing a proper golf swing.

The posture correcting tool (10) is shown having two different units, an adjustable free standing body unit (14) and an adjustable free standing head unit (16).

The adjustable freestanding body unit (14) provides position feedback to a golf player relative to the player's sway during a golf swing.

The adjustable free standing body unit (14) stands on first weighted foot plate (34) and a second weighted foot plate (40), not shown in this Figure, which a golf player does not stand on.

The adjustable free standing body unit (14) can have a first telescoping leg (19), which can be substantially vertical, for right hip alignment. The first telescoping leg (19) telescopes out to about 60 inches, such as having an overall extension of about 56 inches for a tall golfer.

The first telescoping leg (19) can have at least three segments, a first outer segment (20) that can be tubular and can have an overall length between about 15 inches to about 20 inches. The second intermediate segment (22), which can also be tubular and can be slightly shorter than the first outer segment. The second intermediate segment (22) can have a length between about 14 inches to about 19 inches. The third inner segment (24) which is also referred to herein as the innermost segment can be slightly shorter in length than the second intermediate segment, and can range in length between about 13 inches to about 18 inches, allowing the second intermediate segment (22) and third inner segment (24) to nest within the first outer segment (20).

Figure 2:
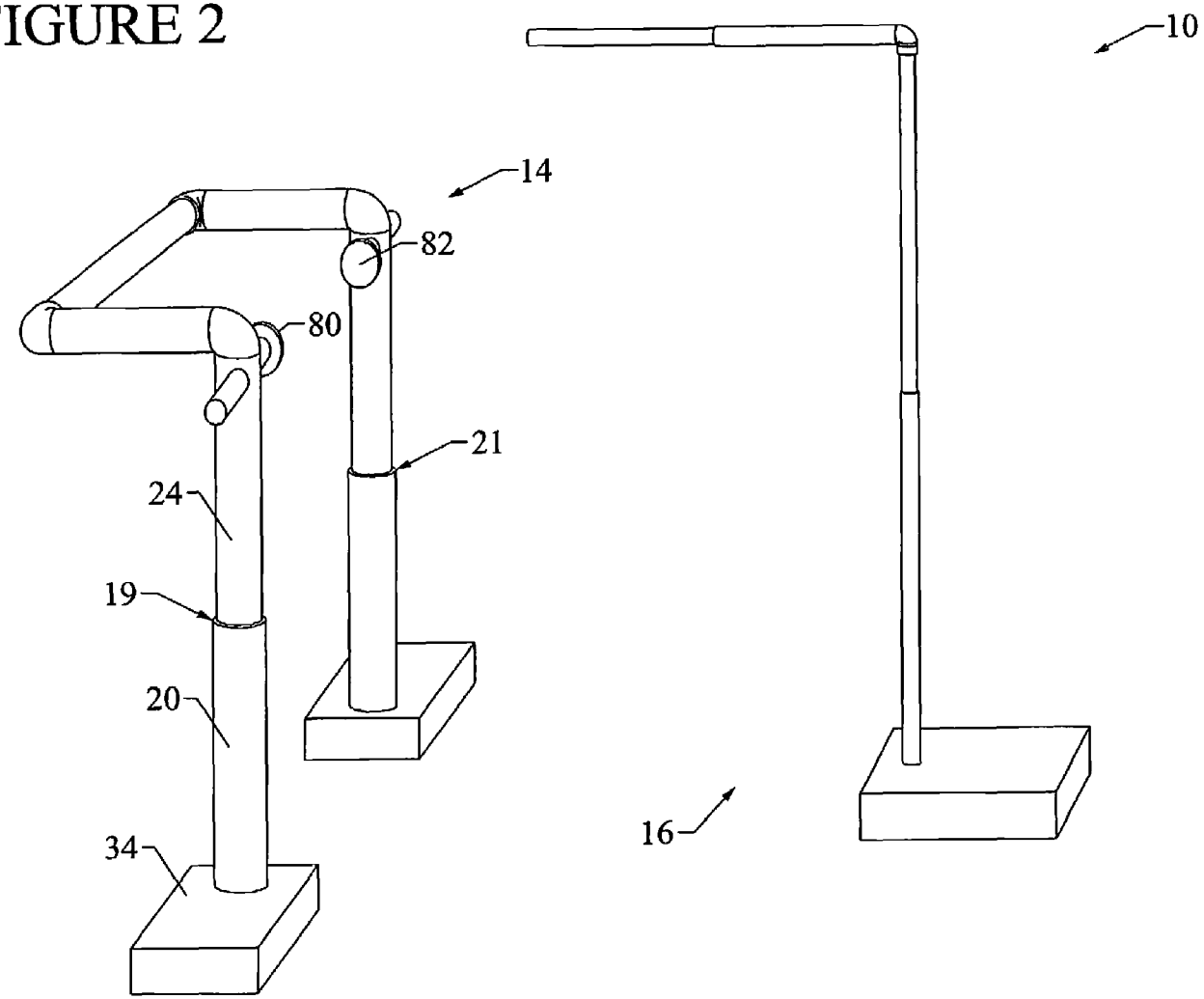
FIG. 2 shows another embodiment of the invention.

FIG. 2 further shows first extension and second extension (80, 82), which can be used to touch the golf player's leg if the player's stance has feet wider apart then the hips. The first and second extension can be removable, slidable and movable.

In an embodiment, the leg segments can have one or more perforations (26, 28) in order to provide improved stability during light wind.

In an embodiment, it can be contemplated that the third inner segment (24) can be solid or hollow. The first outer segment (20) and the second intermediate segment (22) can also be hollow.

FIG. 2 shows another embodiment of the invention. It is contemplated that only two segments can be used for each of the legs, a first outer segment (20) and the third inner segment (24). In such an embodiment, the first outer segment can have a length ranging from about 26 inches to about 34 inches, and the third inner segment (24) can have a length ranging from about 25 inches to about 33 inches, providing an overall length of ranging from about 26 inches to about 66 inches when both segments are engaged together.

The segments can be hollow tubes, that can have a wall thickness of between about 0.050 inches to about 0.060 inches to insure adequate strength and resistance to deformation if the player falls or trips on it during a practice session.

It is contemplated that full extensions of each segment are not required to use the device, however, both telescoping legs can be extended to the same length to provide a balanced structure.

The telescoping legs can be made from fiberglass, a durable impact resistant plastic, aluminum, other lightweight alloys, polymer composites, and combinations thereof.

The telescoping legs can be formed with a powder coating particularly if the legs are made from metal, to reduce the likelihood of attracting lightening during golf practice outdoors.

An embodiment contemplates that the telescoping legs can also be made of a stiff, durable insulating material to insure a safe golf practice device, without shocking, which is a particular problem when golfing in Utah and Arizona.

Figure 3:
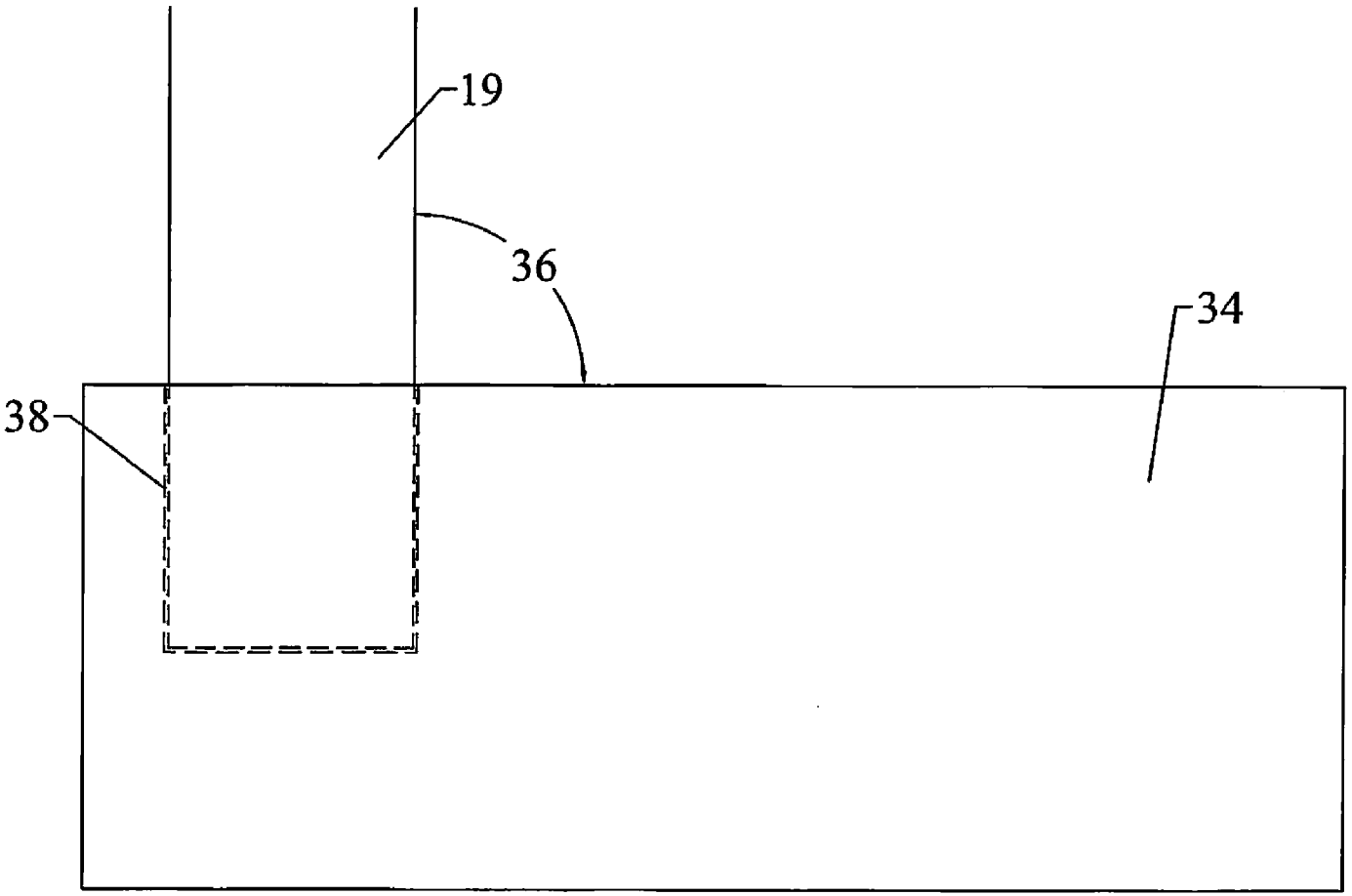
FIG. 3 shows a detail of the weighted foot plate that engages a portion of each of the telescoping legs.

FIG. 3 shows a detail of the weighted foot plate that engages a portion of each of the telescoping legs. A first weighted foot plate (34) is depicted engaging first telescoping leg (19) at about a 90 degree angle (36). An embodiment the first telescoping leg can be threaded to the weighted foot plate.

In this Figure the first weighted foot plate (34) is shown with a depression (38) formed in a top portion of the plate. The depression can be circular and generally identical to the outer diameter of each outer segment of each telescoping leg. The telescoping leg can further engage each foot plate using a sliding snug fit, friction to hold the leg to the plate.

Figure 4:
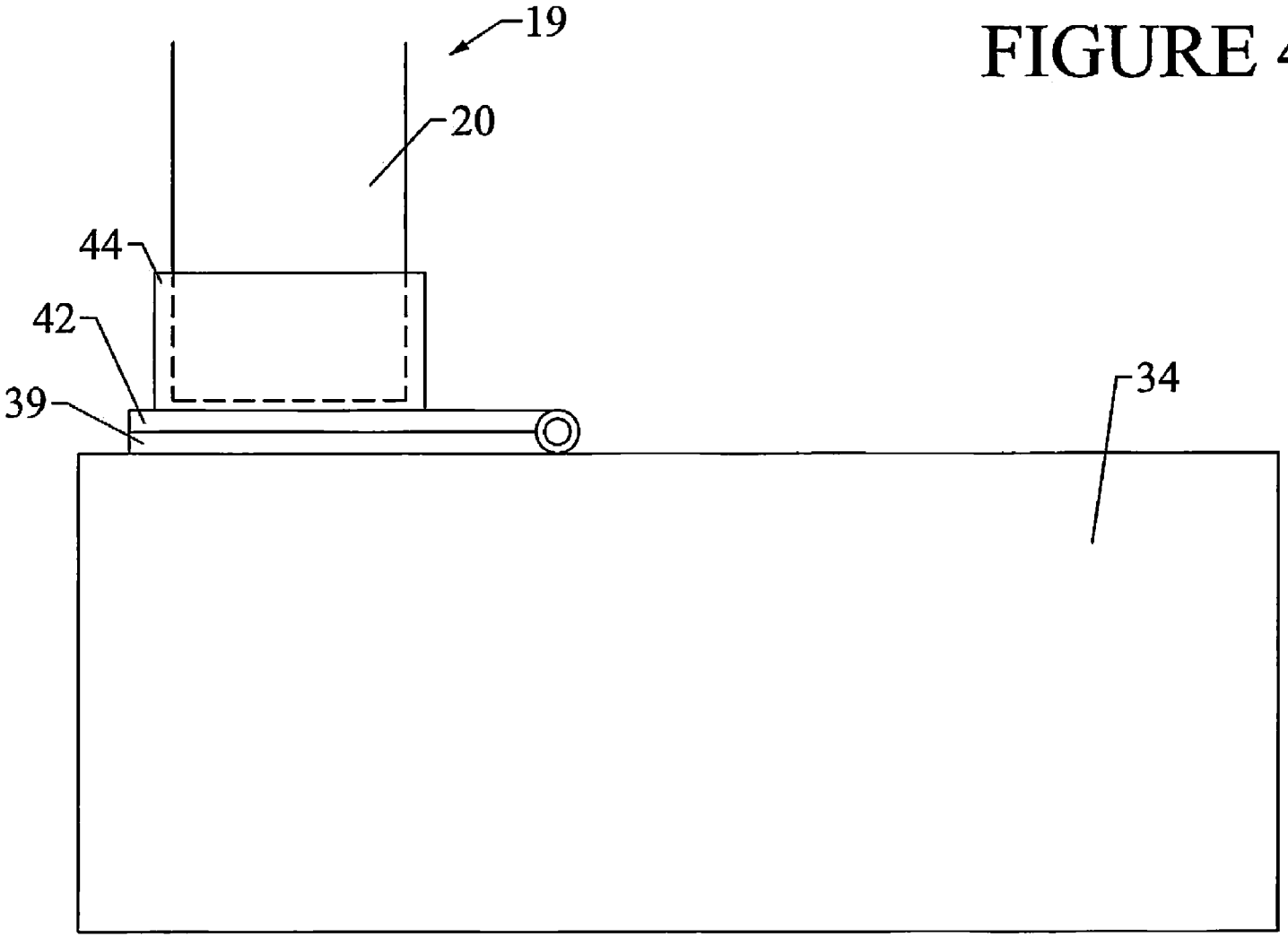
FIG. 4 depicts the weighted foot plate having a plate with a hinged locking foot portion.

In still another embodiment shown in FIG. 4, contemplates that the first weighted foot plate (34) can have a plate (39) with a hinged locking foot portion (42) A collar (44) can be welded to or formed as a one piece structure with the hinged locking foot portion (42) of the plate (39) for receiving the first outer segment (20). The collar (44) can be fixed to the hinged locking foot portion (42).

In this embodiment, the hinged locking foot portion (42) can be rotatable from a position flush with the plate (39) to about a 90 degree angle. The first outer segment (20) of the first telescoping leg (19) can then slide into the collar (44), enabling a secure fit between the plate (39) and the first outer segment (20).

Figure 6:
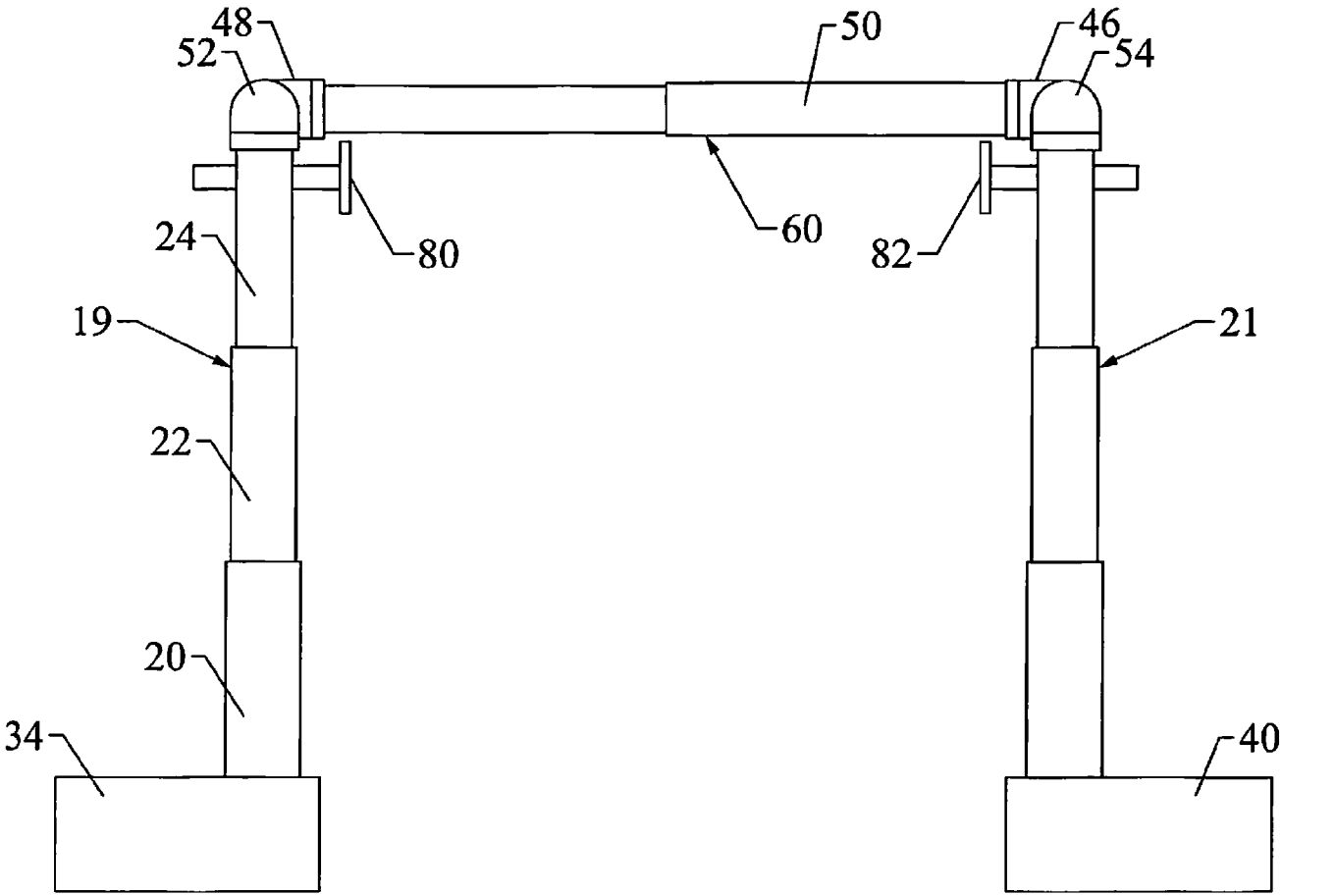
FIG. 6 shows a back view of the body unit with the buttocks bar in an extended position between the two legs.

The first weighted foot plate (34) can be connected to the first telescoping leg (19) at an angle between about 90 degrees to about 110 degrees. The second weighted foot plate (40) can be connected to the second telescoping leg (21) at an angle between about 90 degrees to about 110 degrees, which is shown in FIG. 6.

Figure 5:
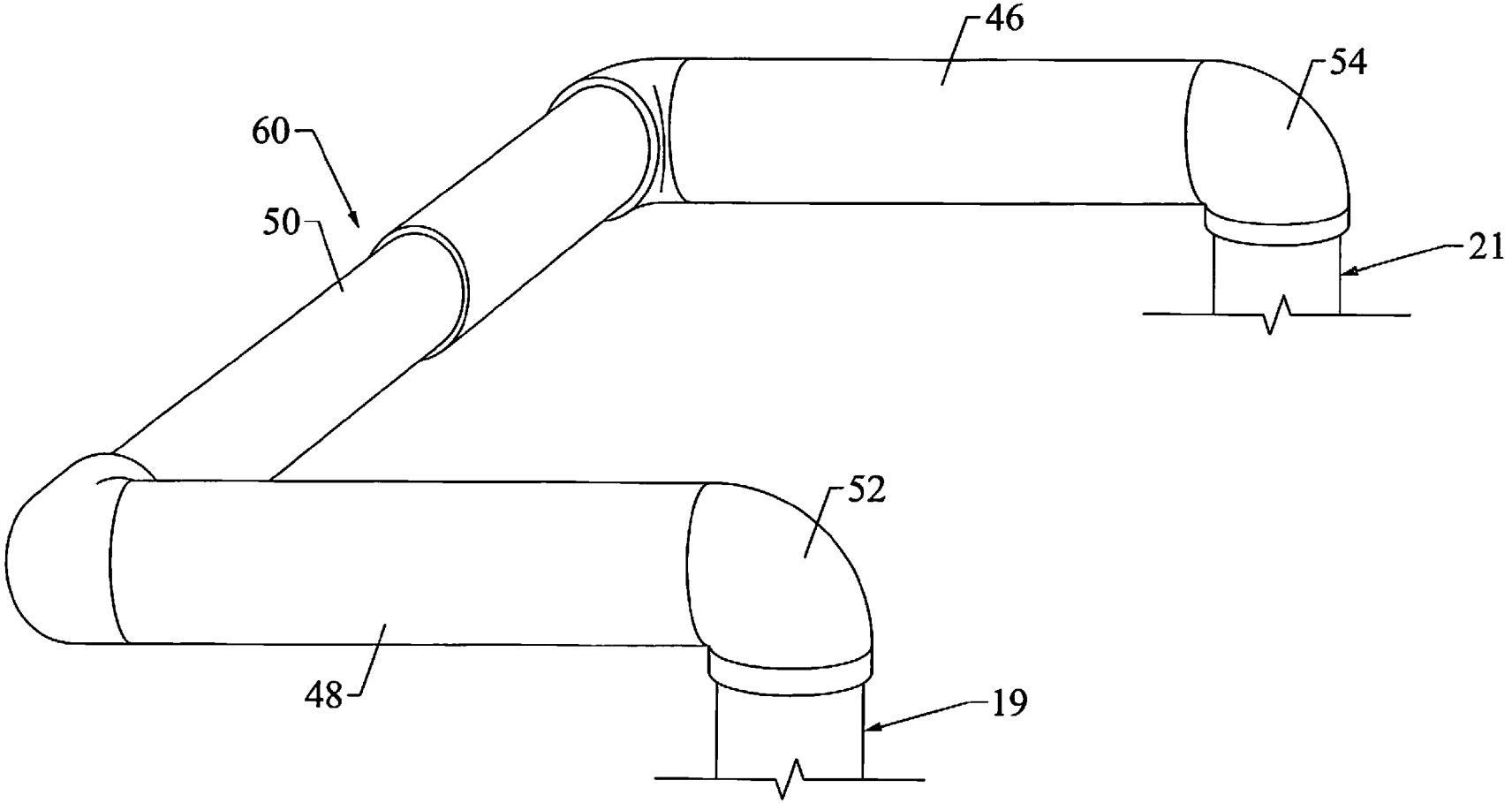
FIG. 5 depicts the buttocks bar of the invention.

FIG. 5 depicts the buttocks bar (60) with a left segment (46) and a right segment (48) and an inner segment (50) between the left and right segments. The buttocks bar can be contemplated to have movable pivotable flanges that enable the buttocks bar to be angled to the correct position behind a player about to practice a golf swing. The buttocks bar can be angled from a horizontal plane between the two telescoping legs of between about 10 degrees to about 30 degrees.

The buttocks bar (60) can be substantially horizontal, slidably and moveably connected between the first telescoping leg (19) and second telescoping leg (21). The buttocks bar (60) can be formed from three segments enabling the tool to fit any sized person.

The left segment (46) can engage the second telescoping leg (21) and the right segment (48) can engage the first telescoping leg (19), as shown in this Figure.

The left segment (46) and right segment (48) can be the same length. The left segment (46) and right segment (48) can be between about 6 to about 15 inches each, enabling a total width to of about 30 inches. The inner segment (50) can be between about 8 inches to about 12 inches. The inner segment nests inside the left segment and right segment, forming a telescoping/collapsing piece of the overall body unit.

It is contemplated that the left segment and right segments can have loops in each end, formed of the same material as the buttocks bar, and these can slide rigidly over the outer diameter of the tops of the first telescoping leg (19) and second telescoping leg (21) while in the extended position.

In an embodiment, the left segment and right segment can each have an adjustable flange (52, 54) enabling the bar to be oriented by the player between a variety of angles.

The buttocks bar (60) can be designed to slide so that the buttocks of the player can touch during proper golf swing practice if desired, and only not touch when the golf swing was incorrect.

It is contemplated that the buttocks bar can be made of a tubular material and that the left segment and the right segment can be hollow for receiving the inner segment.

In and embodiment the inner segment can be solid material, rather than tubular. However, if all segments are hollow then the device would be lightweight which can provide an inexpensive shipping cost, as it is contemplated that the entire structure would have a weight less than about 15 pounds.

The buttocks bar (60) can be positioned at a central position to the player's buttocks (a take away and complete golf swing);

FIG. 6 shows a back view of the adjustable free standing body unit (14) with the buttocks bar (60) in an extended position between the first telescoping leg (19) and the second telescoping leg (21).

Figure 7:
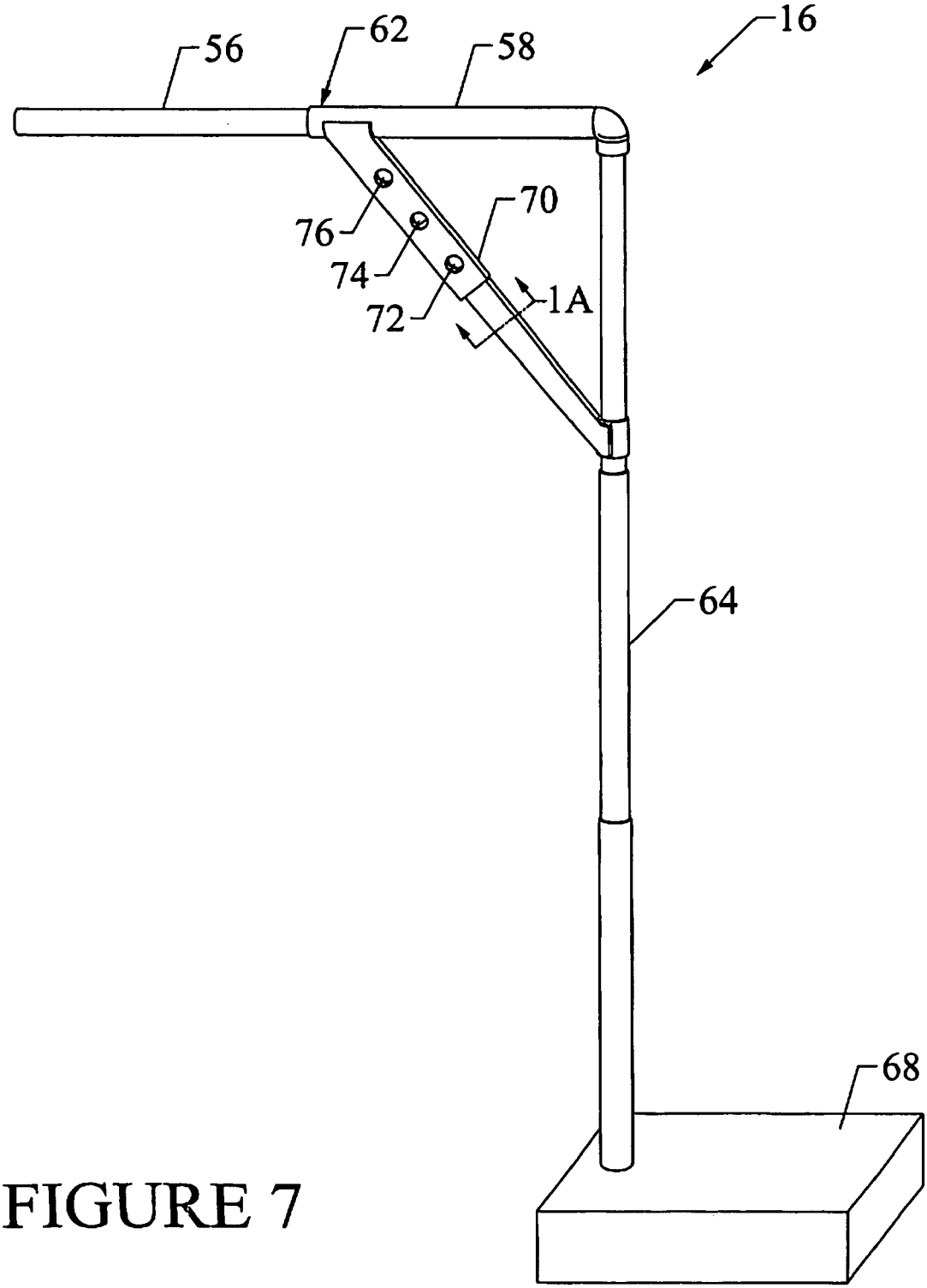
FIG. 7 shows the head unit of the invention.

FIG. 7 shows the adjustable free standing head unit (16) of the invention.

The adjustable free standing head unit (16) can be independent of the adjustable free standing body unit (14) and can be disposed opposite the adjustable free standing body unit (14). Both free standing units can be adjustable.

The horizontal head bar (62), can be telescoping and can telescope to an overall length of between about 3 feet to about 5 feet. For kids, the horizontal head bar (62) can be shorter and can be between about 3 feet to about 4 feet.

The horizontal head bar (62) can be made of two telescoping sections as shown in this Figure as a first section (56) and a second section (58).

The horizontal head bar (62) can connect to an adjustable substantially vertical head bar (64).

A stabilizing connector bar (70) can be pivotable and can be used when the vertical head bar (64) is fully or at least partially extended, to provide collapsible stabilization to the adjustable free standing head unit (16) during use. The stabilizing connector bar (70) can have multiple holes in it (72, 74, 76) enabling it to stabilize the vertical head bar (64) in a variety of extended positions. Cross sectional line 1A is depicted and is further referenced with respect to FIG. 8 below.

The stabilizing connector bar can be a half a tube, a U-shaped unit, so that it can nest against an adjustable substantially vertical head bar when in the collapsed position.

Figure 8:
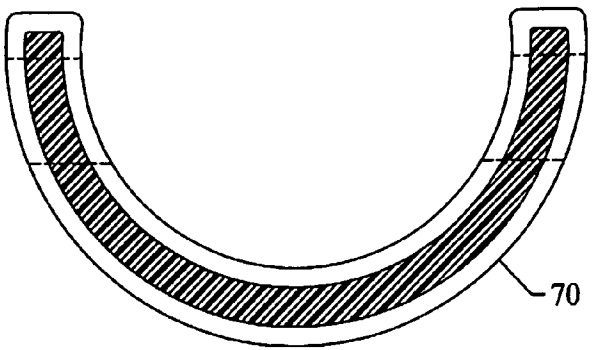
FIG. 8 depicts a detailed view of the connector stabilizing bar.

FIG. 8 depicts a U-shaped embodiment of the stabilizing bar 70. A cross sectional view of the U-shaped embodiment of the stabilizing bar 70 is shown, wherein the cross section shown corresponds to cross sectional line 1A of FIG. 7.

In another embodiment the stabilizing connector bar can be a telescoping flat bar of metal that can be adjusted, such as with a wing nut.

A third weighted foot plate (68) can connect to the vertical head bar (64).

Each weighted foot plate can have an overall dimension of between about 6 inches to about 9 inches in length, between about 3 inches to about 5 inches in width, and a thickness between about 0.75 inches to about 1.5 inches.

Each weighted foot plate can weigh between about 1 pound to about 5 pounds to be stable.

The head bar can be arranged to match a position slightly taller, or greater than a height of the golf player when correctly performing a golf swing.

The head unit can regulate up and down movement of a player's head during the golf swing.

It should be noted that both the second and third foot plates can be positioned apart from the feet of the player enabling a golfer to practice a golf swing by standing with the player's hips aligned with the first and second telescoping legs, the player's buttocks against the buttocks bar, and the player's head positioned beneath but not touching the head bar guiding the player to make a correct golf swing and follow-through.

An embodiment contemplates that a hook and loop fabric can be used, such as Velcro™ to surround the various parts of the tool parts, thereby creating a small collapsed package for easy light shipment.

Still another embodiment contemplates that the weighted foot plates can be threadably engaged with the vertical telescoping legs.

Each telescoping leg can have in another embodiment, a locking mechanism that enables the legs to be extended and locked, or retracted and locked enabling adjustment of the tool for use between large and small players. It is also contemplated that the telescoping legs can twist and lock into place in another embodiment without the need for fasteners.

In an embodiment, the weighted foot plates can be hollow.

It is contemplated that the tool can be adjusted for use with putting swings, chip swings and driving swings.

A small closable carrying case can be used with the invention for containing the free standing body unit and free standing head unit.

Figure 9:
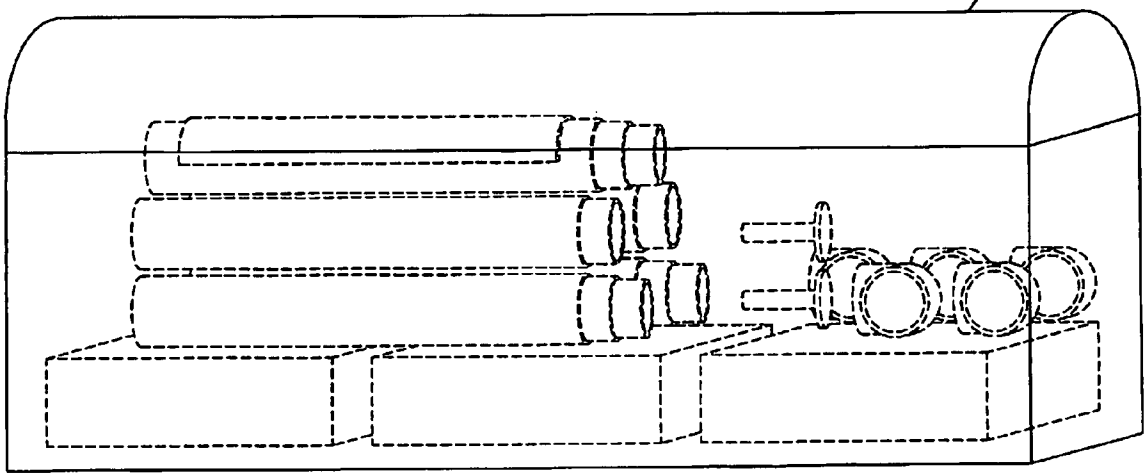
FIG. 9 depicts a small carrying case for the apparatus.

FIG. 9 depicts a carrying case 100.

While these embodiments have been described with emphasis on the embodiments, it should be understood that within the scope of the appended claims, the embodiments might be practiced other than as specifically described herein.

What is claimed is:

1. A posture correcting tool surrounding a player while performing a swing practice comprising:

a. an adjustable free standing body unit adapted to provide position feedback to a player relative to the player's sway during a golf swing, wherein the adjustable free standing body unit comprises:

(i) a first substantially vertical telescoping leg for right hip alignment;

(ii) a first weighted foot plate connected to the first substantially vertical telescoping leg at an angle between 90 to 110 degrees;

(iii) a second substantially vertical telescoping leg for left hip alignment;

(iv) a second weighted foot plate connected to the second leg at an angle between 90 and 110 degrees; and (v) a substantially horizontal buttocks bar slidably and moveably connected between the first and second telescoping legs adapted to allow a player to adjust the buttocks bar at a central position to the player's buttocks (a take away and complete golf swing; wherein the first telescoping leg and the second telescoping legs comprise a removable, slidable and movable first extension and second extension respectively; these extensions are set to touch the player's legs if the player's stance has feet wider apart than hips; the extensions are attached through and perpendicular to the first and second telescoping legs respectively;

b. an adjustable free standing head unit independent of the body unit and disposed opposite the adjustable free standing body unit, comprising:

(i) a telescoping substantially horizontal head bar;

(ii) an adjustable substantially vertical head bar support connected to the horizontal head bar; and (iii) a third weighted foot plate connected to the adjustable substantially vertical head bar support wherein the head bar can be arranged to match a position slightly greater than a height of the player when correctly performing the golf swing, and wherein the head unit regulates up and down movement of the players head during the golf swing and wherein second and third foot plates are positioned apart from feet of the player; whereby a golfer can practice a golf swing by standing with the hips aligned with the first and second legs, the buttocks against the buttocks bar, and the head beneath but not touching the horizontal head bar to guide the player to make a correct golf swing and follow-through.

2. The posture correcting tool of claim 1 wherein the vertical telescoping legs are fabricated from fiberglass, a durable impact resistant plastic, aluminum, lightweight alloys, polymer composites, and combinations thereof.

3. The posture correcting tool of claim 1, wherein the weighted foot plates provide a threadable engagement with the vertical telescoping legs.

4. The posture correcting tool of claim 3, wherein each weighted foot plate has a 6 inch length to a 9 inch length, a 3 inch width to a 5 inch width, and a thickness between 0.75 inches to 1.5 inches.

5. The posture correcting tool of claim 1, wherein each weighted foot plate comprises at least 1 pound to 5 pounds of weight.

6. The posture correcting tool of claim 5, wherein the foot plates are hollow.

7. The posture correcting tool of claim 1, wherein each telescoping leg further comprises a locking mechanism that enables the legs to be extended and locked, or retracted and locked enabling adjustment of the tool for use between large and small players.

8. The posture correcting tool of claim 1, wherein the apparatus can be adjusted for use with putting swings, chip swings and driving swings.

9. The posture correcting tool of claim 1, further comprising a small closable carrying case for containing the body unit and head unit.

10. The posture correcting tool of claim 1, further comprising a stabilizing connector bar engaging between the horizontal head bar and vertical head bar.

11. The posture correcting tool of claim 10, wherein the stabilizing connector bar is telescoping, adjustable and detachable.

12. The posture connecting tool of claim 11, wherein the stabilizing connector bar is U-shaped for a snug fit in a collapsed position against the vertical head bar.

* * * * *